United States Patent [19]

Guerin

[11] Patent Number: 4,601,279

[45] Date of Patent: Jul. 22, 1986

[54] PYROLYTIC SELF-CLEANING DOMESTIC OVEN WITH IMPROVED MEANS FOR PROTECTING ELECTRONIC PANEL AND CONTROLS FROM HEAT DAMAGES

[75] Inventor: Jacky Guerin, Mertzwiller, France

[73] Assignee: Societe de Dietrich, Niederbronn-les-Bains, France

[21] Appl. No.: 775,211

[22] Filed: Sep. 12, 1985

Related U.S. Application Data

[63] Continuation-in-part of Ser. No. 629,491, Jul. 10, 1984, abandoned.

[51] Int. Cl.[4] ..... A21B 1/00

[52] U.S. Cl. ..... 126/21 A; 126/21 R; 126/39 R; 219/393

[58] Field of Search ..... 126/21 R, 1 AA, 1 AD, 126/1 B, 1 C, 39 R, 39 BA, 39 C, 21 A, 80; 219/393, 394, 396, 398, 400, 402, 406, 407, 412, 413, 414

[56] References Cited

U.S. PATENT DOCUMENTS

| | | | |
|---|---|---|---|
| 3,310,046 | 3/1967 | Scott et al. | 219/393 X |
| 3,587,557 | 6/1971 | Henderson | 126/21 A |
| 3,858,568 | 1/1975 | Seidel | 126/21 R X |
| 3,882,843 | 5/1975 | Barnett | 126/21 A X |
| 3,889,099 | 6/1975 | Nuss | 219/393 |
| 3,977,387 | 8/1976 | Lawler | 126/21 A |
| 4,331,124 | 5/1982 | Seidel et al. | 126/21 A |
| 4,354,084 | 10/1982 | Husselkin et al. | 126/21 A X |
| 4,375,213 | 3/1983 | Kemp et al. | 126/21 A |

*Primary Examiner*—Larry Jones

*Attorney, Agent, or Firm*—Erwin S. Teltscher

[57] ABSTRACT

An oven, particularly a household cooking/baking oven which has a pyrolytic-type self-cleaning mode of operation, is provided with a ventilation system for preventing the temperature of the oven controls, particularly electronic controls, which are provided out near the front on the cabinet, from being subjected to too high, possibly or probably degrading or disabling temperatures, e.g. while the pyrolytic self-cleaning operation is taking place. In particular, a forced air ducting system is provided between the exterior of the oven cavity and the interior of the oven cabinet. The fresh air intake for this system is interposed between the controls and the exhaust, in such a way as to bathe much of the peripheric of the controls with cool air.

4 Claims, 4 Drawing Figures

FIG. 3
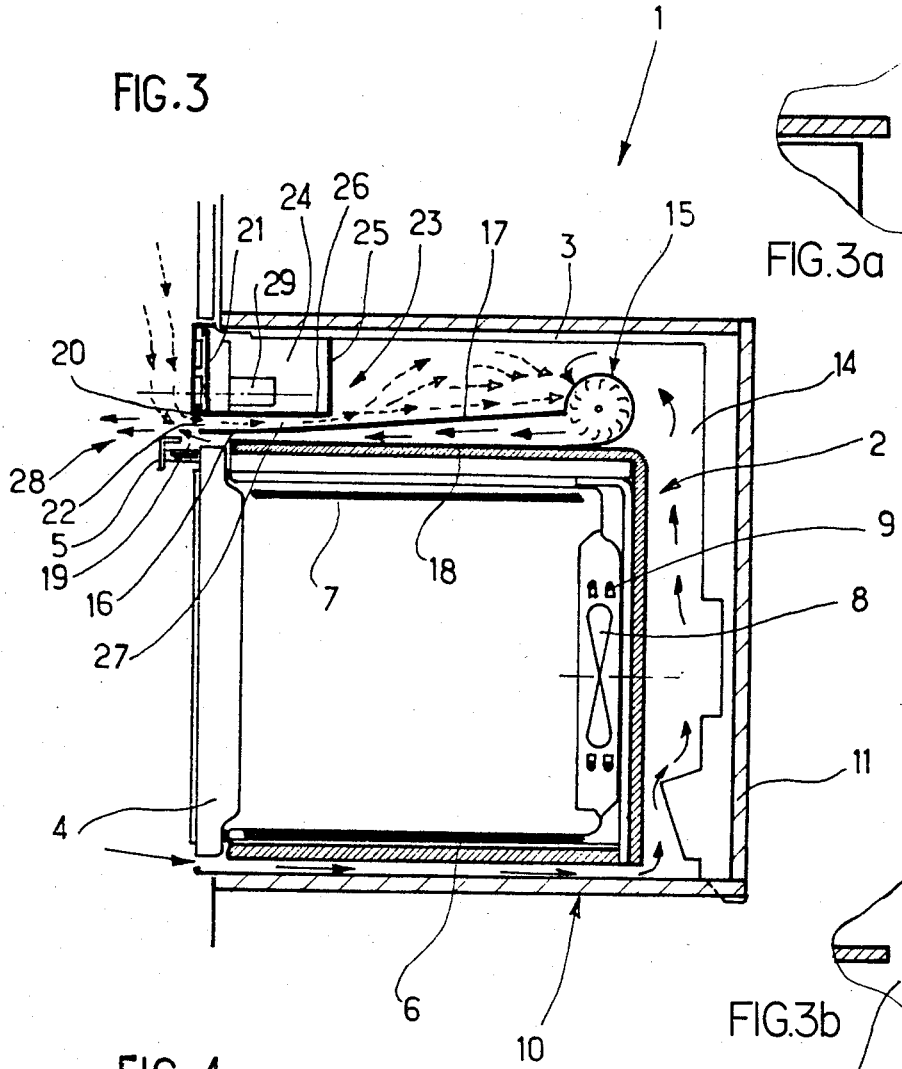
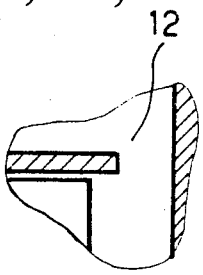
FIG. 3a
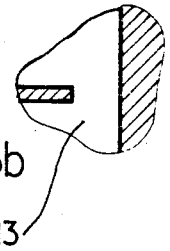
FIG. 3b
FIG. 4
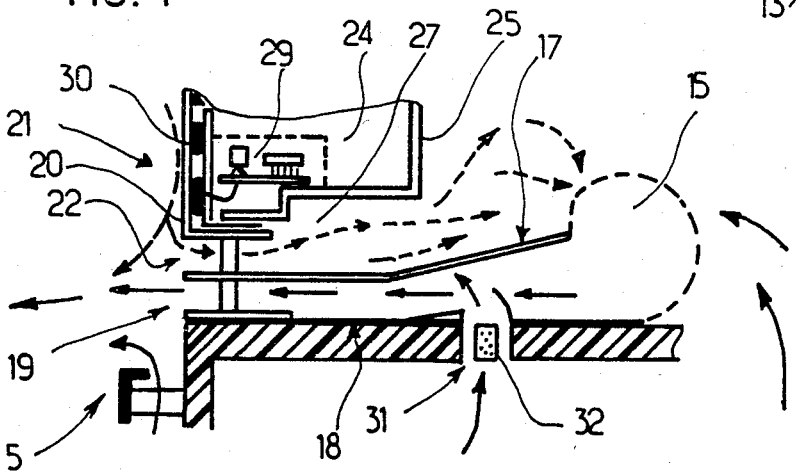

PYROLYTIC SELF-CLEANING DOMESTIC OVEN WITH IMPROVED MEANS FOR PROTECTING ELECTRONIC PANEL AND CONTROLS FROM HEAT DAMAGES

CROSS-REFERENCE TO RELATED APPLICATIONS

This is a continuation-in-part of application Ser. No. 629,491 filed July 10, 1984 now abandoned.

BACKGROUND OF THE INVENTION

The present invention relates to ways and means for effectively lowering the degree of elevated temperature to which the electronic panel and controls of an oven are subjected, in case of a domestic cooking/baking oven which has a pyrolitic-type self-cleaning cycle or mode of operation, e.g. during which the temperature of the oven cavity is raised to about 550° C. for the purpose of carbonizing or burning-off encrustations and spills from the internal, bounding surface of the oven cavity.

Various previous U.S. patents are pertaining to cooling air flow path(s) inside a domestic cooking or baking oven in order to limit temperature elevation.

U.S. Pat. No. 4,354,084 HUSSLEIN relates to a double built-in baking oven unit which avoids intense heat development in the upper part of the housing. The upper oven is a microwave oven.

Cooling-air channels are located between the housing and the ovens. Inlet and outlet openings are disposed above the controls of the ovens and connected to a lower cooling air inlet opening located at a lower limit of the housing below the lower baking oven through a blower. Shielding plates are disposed both above and below the lower baking oven and are connected to lateral and rear shielding walls in order to form cooling-air channels.

The space formed in a built-in furniture unit and the shielding plates and walls are used as cooling-air channels.

The upper edge of the control panel is bordered by a ventilating strip provided with a hot-air outlet opening connected to a large enclosed hot-air exhaust channel or duct. A cooling air inlet opening extends approximately one third of the length of the strip and is connected through the microwave generator to one entry of the suction part of the blower so that the blower may directly draw the ambient air as cooling air from the outside. This cooling air current intensively cools the microwave generator.

The reduction of temperature comes from the long distance between the oven and the control panel over the microwave oven. It is well known that microwave ovens do not produce a lot of hot air because of microwave heating effect comes from molecule vibration inside the goods to be cooked. Furthermore the air is considerably mixed with fresh air coming from outside so that the temperature of exhausted air is not so high. Furthermore the exhaust channel is very large so that temperature on the control panel may be under 70° C.

This principal advantage results from using numerous openings for fresh air in conjonction with the above said special type of air guidance. This arrangement is sufficient in the case of the double oven, one of both is a microwave oven but will be completely unefficient in the case of a single pyrolytic self-cleaning oven.

U.S. Pat. No. 4,331,124 SEIDEL relates to a gas-fueled oven capable of assuming safely high temperatures such as occur during pyrolytic self-clean cycles. According to this invention a blower is strategically positionned so as to provide flow of cooling air to the walls and the components. Exhaust channel opening is positionned above the control panel, the fresh air is sucked in from under the control panel. The fresh air flow and the hot air flow are mixed before evacuation so that temperature is quite reduced. This kind of method which consists in sucking in fresh air under the control panel and blowing it after mixing with hot air is quite logic and of course obvious. The control panel is not too much heated because of hot air escaping above its upper edge. Furthermore this kind of control panel is not provided with electronic components.

U.S. Pat. No. 4,375,213 KEMP relates to a pyrolytic self-clean gas-fueled built-in oven having means for passing cooling air over the heated walls. This kind of solution to overcome the problem of overheating during pyrolytic phase is particular to gas-fueled ovens. Of course the solution is achieved by exhausting the hot combustion products through an opening located below and between cooling air exhaust openings so that hot combustion air will upon rising mix with the exhausted cooling air outside the enclosure.

Separate exhaust openings for hot combustion air are located under the two superposed channels of exhausted cooling air.

This kind of disposition is typical of ovens provided with gas burners but will not be useful in case of an electronic control panel located in the upper part of the enclosure because temperature in this region is still too high for electronic components.

These days many household cooking/baking ovens are provided with electronic controls, e.g. which include semi-conductor chips, integrate circuits, photodiode displays and the like, which are designed to operate within a limit range of environmental temperature, and which may become destroyed, degraded or inoperative if subjected to too high a temperature for too long a length of time. Often, such electronic controls are not manufactured by the manufacturer of the oven; rather the oven manufacturer often buys them more or less as a standard item from an outside supplier. In such instances, the controls may be furnished by the supplier together with a set of conditions of use, which, if not observed, would void the supplier's guarantee to the oven manufacturer as to the fitness and freedom from defects, of such controls. The controls manufacturers and electronic components manufacturers specify that the average control components and the control panel shall not be subjected to a temperature of more than 60° C.

Quite often, manufacturers of household ovens contemporaneously produce one or more series of various ovens with a range of features for sales at various price levels and to users with various needs and inclinations. Accordingly, it is quite common for a domestic cooking/baking oven manufacturer to offer models of oven having a self-cleaning mode of operation, e.g. a pyrolytic cleaning cycle. In such a case, the model with that feature would likely have additional control circuits and a vertical opening or exhaust of the cooking/baking cavity for very high air temperature which must be actuated in order to initiate control and carry out the self-cleaning cycle.

For reasons of economy, such oven manufacturers would highly prefer to use all electronic components of the controls, including the electronic controls of a common and average kind on their self cleaning oven. The trouble is, that with heretofore conventional mechanical designs of pyrolytic self-cleaning type domestic cooking/baking ovens, the temperatures are likely to become so high, even in the relatively external, relatively out-in-front or up-on-top usual location of such controls, that the controls and electronic components manufacturer's specified upper limit for environmental temperature would be exceeded. Accordingly, heretofore the oven manufacturers have had to choose among the not fully satisfactory alternatives of taking a chance on using electronic components which might fail due to the excess heat; using a non-standard, more rugged design of electronic controls for one or both models, at greater expense; or, using mechanical or electromechanical controls which seem not so versatile or up-to-date to the consumer and which do not work properly under high temperature conditions.

One might think that the usual openings and crevices between the elements of a mass produced oven would be such as to provide adequate ventilation for the controls in such an instance, but always, such is not sufficient. In case of pyrolytic self cleaning operational mode ovens conventional ventilation even powerfull is not sufficient to eliminate problems.

One might also think that the problem could be solved another way, that is, by attempting to thermally insulate the controls instead of by trying to ventilate them. However, this way is not possible. The insulation even thick would never be sufficient during pyrolytic self-cleaning operation because of the high tempereature inside the oven cavity forcing the heated air to escape through the upper exhaust provided with a catalytic cartridge and being finally ejected near the control panel and near the electronic components housing.

SUMMARY OF THE INVENTION

An oven, particularly a household cooking/baking oven which has a pyrolytic-type self-cleaning mode of operation, is provided with means for preventing the temperature of the oven control panel having sensitive contacts and of the electronic control components to raise over 550° C., which are provided on the front and out near the front inside a housing, from being subjected to too high, possibly or probably degrading or disabling temperatures, e.g. while the pyrolytic self-cleaning operation is taking place. In particular, a new arrangement including a forced air ducting system provided between the upper part of the oven cavity and the lower part of controls housing with a fresh air intake for this system interposed between the controls and the exhaust, in such a way as to insulate much of the periphery of the control panel and components housing with a mattress of fresh air coming from outside after having sloped down vertically along the front of the control panel.

For instance, the invention seeks to provide an improved arrangement of air flow path that will keep the temperature to which the controls on the control panel are subjected, down below 60° C., even when the inside of the oven cavity is being maintained at a temperature in the neighborhood of 550° C. for a subtantial period of time.

Furthermore, the accumulated heat in the oven during pyrolytic phase will not disable even destroy the electronic components or the control panel after a ventilator breakdown due to the high efficiency of the invention.

The structures that the invention is concerned with keeping cool are the semi-conductors, integrated circuits, photodiode displays, sensitive contacts and the like housed in the control panel and behind the control panel in a housing, both facially of and within that control panel and in that housing. It is not concerned with the temperature to which the thermocouple or other temperature-sensing element in the oven cavity may be subjected. Such an element, for the purposes of the present invention would be considered to be operatively connected with, and to report to the electronic controls of the oven, but not to be a part that is need of temperature protection. In virtually all instances, the temperature probes are built to withstand the high temperatures, and need no protection.

In general, the present invention involves a combination of means for refreshing the upper part of the oven where controls are located in drawing cool air from outside along a space provided between the heated air duct path and the electronic components housing just under the lower horizontal plate of that housing and just above the heated ejected air duct forming with drawing cool air path and insulating mattress of high efficiency in such a manner that the front side of control panel is efficiently refreshed, the housing of electronic components is perfectly insulated and the upper part of the front access door where the handle is located is refreshed too.

The combination of means according to the present invention is so efficient that danger of disabling or even destroying electronic components, control means and sensitive panel contacts due to too high temperature is completely eliminated.

The principles of the invention will be further discussed with reference to the drawing wherein a preferred embodiment is shown. The specifics illustrated in the drawing are intended to exemplify, rather than limit, aspects of the invention as defined in the claims.

BRIEF DESCRIPTION OF THE DRAWING

In the Drawing

FIG. 3 is a somewhat shematic vertical cross section view of an oven provided with the improvement according to the invention.

FIG. 4 is a fragmentary larger scale vertical cross section view of the upper part of an oven provided with the improvement according to the invention.

DETAILED DESCRIPTION

Figure 1:
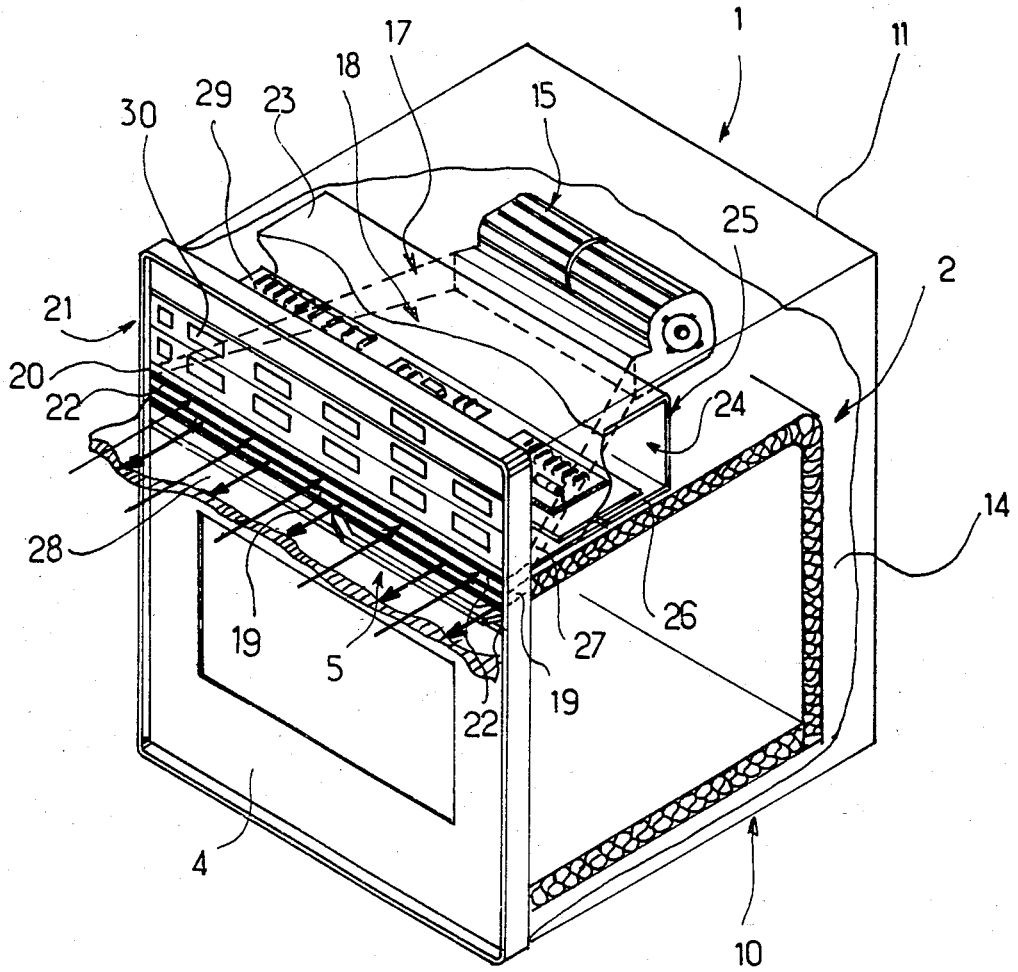
FIG. 1 is a general perspective view of a domestic oven provided with an electronic control panel and electronic control circuits housing in accordance with the principles of the invention.
Figure 2:
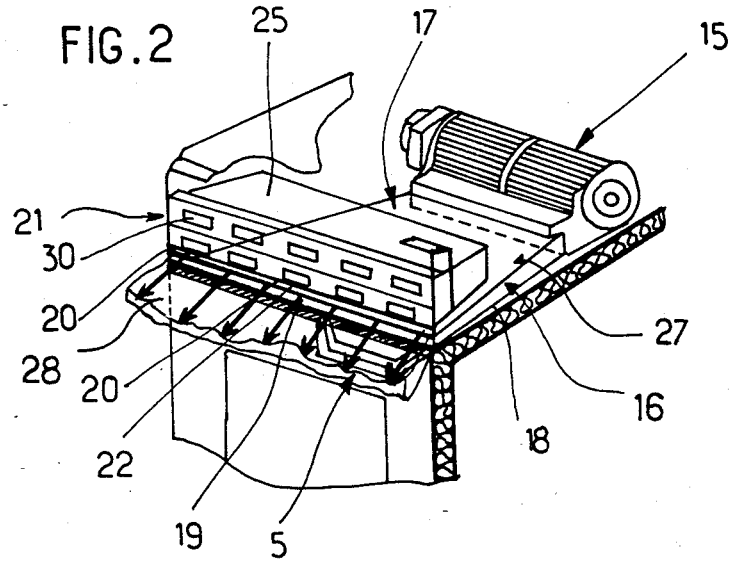
FIG. 2 is a fragmentary dissociated perspective view of the upper region showing more particularly the inner parts of an oven provided with the improvement according to the invention.

In FIG. 1, a domestic pyrolytic self-cleaning cooking/baking oven 1 is seen in perspective representation. This pyrolytic oven is shown including an enclosure 2, which structure defines the oven cavity. The enclosure 2 is housed within a body or frame 3, which is openably closed at its front by a door 4, that typically is hinged along its lower edge so as to be able to be tipped-down to open and tipped-up to close simultaneously the oven frame 3 and the enclosure of the oven cavity 2. A handle for pulling the door open, aiding in closing the door, and particularly, for latching the oven door closed and/or initiating the pyrolysis cycle, is illustrated generally at 5.

Typically, the oven cavity would be provided with heating elements, such as are illustrated at 6, near the oven cavity floor and at 7, near the oven cavity ceiling. In this instance, and also sometimes typically, the oven is equipped as a convection oven, by having a circulating fan provided internally of the oven cavity on the back wall at 8, this circulating fan being shown surrounded by a further heating element 9, so that as cooking/baking and/or pyrolysis is taking place, temperatures within the oven cavity may be homogenized by physical mixing and distribution provided by action of the fan 8 against the heated elements 9, 6 and/or 7.

The oven may be of the built-in type, in which the frame 3 would be recessed into a hole or tailor-made opening provided in the wall of a kitchen. However, in the present instance, and also typically, the oven frame 3 is being shown enclosed around the top, sides, bottom and back by a furniture-like cabinet. Sometimes the frame 3 may be fabricated together as a unitary structure, but, in any event, the frame and cabinet including the door 4 usually form an at least almost completely enclosed volume. It is not uncommon in such instances to provide some small vents from the oven cavity to the outside, and/or from the space between the oven cavity to the outside of the frame 3 and/or the cabinet 10 with its walls 11. To this end, FIG. 3 illustrates at 12 and 13 where an upper and a lower vent might be provided in order to obtain a chimney effect for ventilation.

In FIGS. 1 and 3, numeral 14 designates the envelope of space which is provided between the structure of the oven cavity 2 and the frame 3 or frame/cabinet unit of the oven 1. Usual mechanical structures (not illustrated in detail) are provided for mounting the various structures in relation to one another in any convenient and acceptable manner.

The volume of space 14 is shown communicated to the exterior, e.g. at the front of the oven, through the ducting means of a fan, e.g. an electrically powered centrifugal fan provided within the oven, e.g. at 15, within the volume of space 14. The fan is so arranged to circulate air from the exterior, a part through the space 14 and a part coming from the upper part of the oven and back out to the exterior again on the upper part of the oven. A typical air circulation path is illustrated by a series of arrows in FIG. 1, with upper dashed line arrows indicating air being sucked to the fan 15, upper solid line arrows indicating air being exhausted from the fan and lower solid line arrows illustrating inlet air coming through another vent opening, e.g. below the door hinge, and rising to the vicinity of the fan due in part to warming to this stream of air, i.e. due to thermal convection.

In a usual, conventional oven, if provided with a forced air circulation path between the cavity structure and the frame/cabinet, the comparable fan would typically be situated and ducted to draw-in and expel air along the paths of the solid line arrows that are shown in FIG. 1. A major part of what is considered to be new in accordance with the present invention is also and further ducting the fan 15 to draw in cooling air along the paths of the dashed lines arrows that are shown in FIG. 3 as hereby further described and explained.

The normal ducting 16 for the fan 15 is shown including two convergent surfaces 17, 18 leading to a laterally elongated slot 19 located on the front of the oven, typically running on the upper edge of the access door 4 and under the lower edge of the control panel. The pressure side of the fan 15 is communicated to that slot 19 via the ducting 17, 18. The forced exhausted air is drawing heated air from neigborhood volume due to PITOT effect. Where the oven is provided with further vents 12, 13, some of the air extracted from the space 14 by the fan 15 has gotten into the space 14 through the further vents 12, 13.

An important mean of the present invention is that the oven 1 is further provided with an air elongated inlet slot 22 located between the air outlet slot 19 of the exhaust ducting 17, 18, and the lower edge 20 of the control panel 21, for the oven, e.g. directly under the exterior of the control panel 21 along the whole lenght of the edge 20.

The slot 22 is rectangular and of 5–20 mm width.

A further mean to obtain the results according to the present invention is that the cross section surface of the exhaust slot 19 is identical in value to the cross section blowing surface of the fan 14.

Further in practicing the present invention, the controls disposed on, provided with and/or mounted to the control panel 21 are enclosed behind the control panel, e.g. on the sides, bottom, and back by an enclosing box or housing 23, that preferably is air-tight, so as to provide an entrapped volume 24, and which is made of a material that is a particularly good conductor of heat, e.g. of steel or aluminum or aluminum alloy. In the instance depicted, the enclosure 23 is placed tight agains the inner surface of the frame 3 at the top, so it needs no top wall. However, it would be within the contemplation of the invention to dispose the enclosure 23 somewhat down from the top of the frame and provide it with a top wall of the heat conductive material.

Further, in accordance with principles of the present invention, the enclosure 23 is shaped and situated in the path of the cool air being drawn-in at 22 in such a manner as to constantly bathe much or all of the outside of the enclosure 23, within the space 14 with cooling air.

In general, the cooling air path 27 provided in accordance with the present invention is shown beginning with a laterally elongated slot 22 which communicates with a relatively broad, not very tall duct defined between the top of the exhaust ducting 17 and the horizontal underside of the enclosure 23 at 26, under the controls. Behind the enclosure 23, the cooling air inlet flow path 27 empties into the space 14 at large, so that it may rise and wash along the back wall of the enclosure 23 at 25 on its way to the suction side of the fan 15.

The cooling air path 27 shapes a real efficient insulating mattress between the heat air path and the housing 23. The near front of the housing is also along this path being therefore out of warming influence coming from the oven cavity.

By preference, the slot provided at 19 for the hot air being exhausted from the space 14 is so narrow compared to the throughput capacity of the fan 15, that the hot air jets in a large but thin curtain outwards of the exterior of the oven at 28 to such a distance that it does not tend to reverse and be drawn in at the inlet at 22. Rather, other, cooler air in the vicinity is drawn in at 22, and this cooler air physically separates the stream of hotter air from the control panel. The shape of the slot 22 and the presence of a curtain 28 tend to cause the cooling air that is being drawn towards the slot 22 to traverse the front of the control board 21, thus further tending to lead heat away from the electronic controls, e.g. particularly during operation of the pyrolytic-type self-cleaning cycle of the oven 1.

If desired, any of the controls within the enclosure 23 may be further protected, for instance by being encapsulated with further enclosures 29.

The control panel is a sensitive contacts panel provided with sensitive zones 30 to be actuated by means of a touch with one finger.

This kind of control panels seem to be fragile and sensitive to temperature rising.

The heated air coming from the oven cavity during pyrolytic phase passes in the ducting 17, 18 through a vertical opening 31 provided with a catalytic cartridge 32. The very hot air is cleaned in this catalytic cartridge and is ejected outside along the hot air path and through the slot 19.

The temperature of this air is very high for domestic use and therefore dangerous for the fingers touching the sensitive contacts on the control panel. The arrangement according to this invention obviates this disavantage.

It should now be apparent that the oven with the arrangement according to this invention for protecting electronic controls from heat damage, especially during pyrolytic self-cleaning operational mode as described hereinabove possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. In a cooking/baking pyrolytic self cleaning type oven having:

an inner enclosing structure defining an oven cavity;

means for applying heat to the oven cavity for cooking/baking;

means for providing a pyrolytic-type self-cleaning operation for said oven cavity constructed and arranged to heat said oven cavity to a temperature in the neighborhood of 550° C.;

an outer frame/cabinet enclosing said oven cavity structure as a housing therefor, said frame/cabinet including openable/closable door means for permitting access to the oven cavity, the oven cavity structure being sized, positioned and mounted relative to the frame/cabinet so as to provide an airspace within said frame/cabinet, at least partially blanketing said oven cavity structure;

a control panel for said oven, said control panel being of a sensitive contacts one and generally frontally exposed exteriorly of the oven and including at least one control which extends internally of said frame/cabinet;

electronic control means which are subject to degradation if subjected to a temperature in excess of 60° C.;

inlet slot means in said frame/cabinet defining an inlet from exteriorly of said oven into said airspace;

outlet slot means in said frame/cabinet defining an exhaust outlet from said airspace to exteriorly of said oven, said outlet slot means being at least generally juxtaposed with said control panel;

an exhaust fan having a suction side and a pressure side; and duct means within said airspace communicating said suction side of said exhaust fan with said outlet slot means and communicating said pressure side of said exhaust fan with said outlet slot means, opening means through the oven cavity provided with a catalytic cartridge to evacuate hot air in the said duct means during pyrolytic phase;

the improvement wherein:

said frame/cabinet further includes an inlet means defining a cooling air inlet slot into said airspace, said cooling air inlet being juxtaposed with said control panel located all along its lower edge and intervened between said outlet slot means and said control panel, in such a manner as to substract heat from said control panel and said at least one control, said cooling air inlet being in combination with wall means as a housing defining with said control panel and frame/cabinet a substantially airtight enclosure within said airspace for said at least one electronic control mean, said wall means being made of a good conductor of heat and being arranged to form a box and to be bathed by cooling air entering through said cooling air inlet, cooling air path forming an insulating mattress between the lower plate of the housing and the said duct means, said cooling air inlet is constructed and arranged to draw cooling air frontally across said control panel and into said airspace along at least an underside and a rear face of said box.

2. The cooking/baking oven improvement of claim 1, wherein:

said inlet slot means is so laterally extensive but vertically short that, in use, heated air is exhausted from said airspace by operation of said exhaust fan in a curtain which jets so far outwards of the oven, that at most, little of such heated air is drawn into said airspace through said cooling air inlet as cooling air.

3. The cooking/baking oven improvement of claim 1 wherein:

section surface of said pressure side of the fan is identical to section surface of outlet side means.

4. The cooking/baking oven improvement of claim 3 wherein:

cooling air inlet is rectangular which vertical width is greater than 5 mm but lower than 20 mm.

* * * * *